US010946689B2

(12) United States Patent
Bradley

(10) Patent No.: US 10,946,689 B2
(45) Date of Patent: Mar. 16, 2021

(54) SYSTEMS AND METHODS FOR PROVIDING SECURITY, BINDING, AND LABELING FOR A PLURALITY OF PAPERS AND COVERING, PROTECTING, AND CONCEALING THE RECORDING, VIEWING, OR USING OF PERSONAL, PRIVATE, AND NONPUBLIC INFORMATION

(71) Applicant: Rebecca Bradley, Dandridge, TN (US)

(72) Inventor: Rebecca Bradley, Dandridge, TN (US)

( * ) Notice: Subject to any disclaimer, the term of this patent is extended or adjusted under 35 U.S.C. 154(b) by 0 days.

(21) Appl. No.: 16/668,749

(22) Filed: Oct. 30, 2019

(65) Prior Publication Data

US 2020/0147993 A1 May 14, 2020

Related U.S. Application Data

(60) Provisional application No. 62/757,722, filed on Nov. 8, 2019, provisional application No. 62/899,154, filed on Sep. 12, 2019.

(51) Int. Cl.

| | |
|---|---|
| ***B42F 13/26*** | (2006.01) |
| ***B42F 13/16*** | (2006.01) |
| ***B42F 13/40*** | (2006.01) |
| ***B42F 13/00*** | (2006.01) |
| ***B42F 3/04*** | (2006.01) |
| ***B42B 5/10*** | (2006.01) |

(Continued)

(52) U.S. Cl.

CPC ..... *B42F 13/26* (2013.01); *B42F 3/04* (2013.01); *B42F 13/004* (2013.01); *B42F 13/165* (2013.01); *B42F 13/40* (2013.01)

(58) Field of Classification Search

CPC ..... B42F 13/26; B42F 13/165; B42F 13/40; B42F 13/004; B42F 3/04; B42B 5/10; B42B 5/12; B42D 1/001; B42D 1/009

USPC .... 402/3, 4, 5, 8, 19, 20, 26, 31, 36, 39, 46, 402/503

See application file for complete search history.

(56) References Cited

U.S. PATENT DOCUMENTS 2,178,767 A * 11/1939 Unger ..... B42F 13/0026 402/38

6,270,280 B1 8/2001 Baumann (Continued)

FOREIGN PATENT DOCUMENTS

EP 0704322 A2 4/1996

*Primary Examiner* — Justin V Lewis

(74) *Attorney, Agent, or Firm* — Edwina Thomas Washington; Edwina Washington Law Firm, PLLC

(57) ABSTRACT

Systems and methods for providing security, integrity, binding, maneuverability, and labeling for a plurality of papers, and for covering, protecting, and concealing the recording, viewing, or using personal, private, and nonpublic information on the page. The system includes an un-releasable locking binding device and tamper-evident binding device configured to connect, secure, and papers, which can substantially rotate 360 degrees, fold back upon itself, lie flat when open, and deter and prevent removal and insertion of pages, be tamper evident, and covering devices releasably positioned to cover personal, private, or nonpublic information located on the page. The bound plurality of papers can include an identification label and can be configured as a secure Notary journal notebook having all NonPublic Personal Information (NPPI) fields for a single record on the left or right page and an acronym list.

7 Claims, 10 Drawing Sheets

(51) Int. Cl.
*B42D 1/00* (2006.01)
*B42B 5/12* (2006.01)

(56) References Cited

U.S. PATENT DOCUMENTS

| | | | | |
|---|---|---|---|---|
| 7,946,552 | B1 | 5/2011 | St Claire | |
| 2003/0213154 | A1* | 11/2003 | Park | B42D 1/06 40/647 |
| 2015/0298486 | A1* | 10/2015 | Miyata | B42B 5/103 402/36 |
| 2016/0332478 | A1* | 11/2016 | Jameson | B42F 21/06 |

* cited by examiner

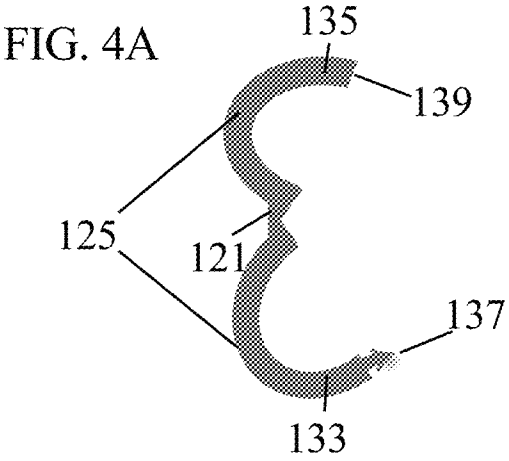
FIG. 4A
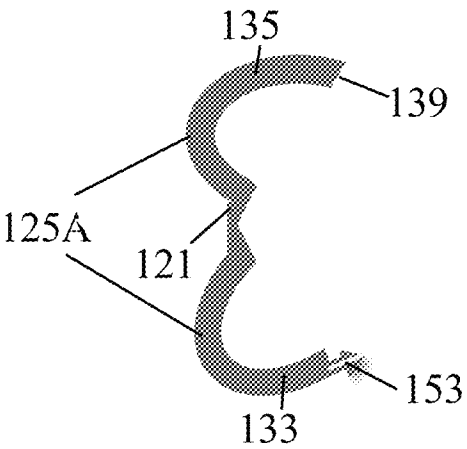
FIG. 4B
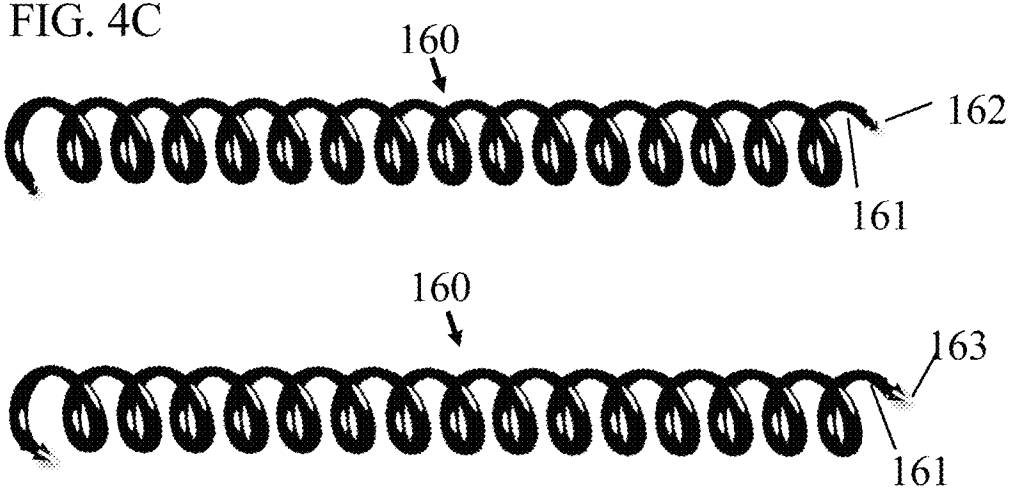
FIG. 4C
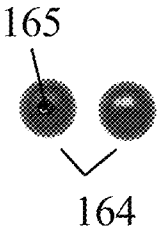

SYSTEMS AND METHODS FOR PROVIDING SECURITY, BINDING, AND LABELING FOR A PLURALITY OF PAPERS AND COVERING, PROTECTING, AND CONCEALING THE RECORDING, VIEWING, OR USING OF PERSONAL, PRIVATE, AND NONPUBLIC INFORMATION

CROSS-REFERENCE TO RELATED APPLICATIONS

This application claims benefit of priority from U.S. Provisional Application Ser. No. 62/757,722, filed Nov. 8, 2018, the entirety which is incorporated herein by this reference and claims the benefit of priority from U.S. Provisional Application Ser. No. 62/899,154, filed Sep. 12, 2019, the entirety which is incorporated herein by this reference.

BACKGROUND

1. Technical Field

The present invention is generally related to systems and methods for providing security, binding, and labeling for a plurality of papers, leaves, sheets, pages, covers, books, notebooks, documents, or other stationery (collectively referred to as papers) and for covering, protecting, or concealing the recording, viewing, or using personal, private, and nonpublic information.

2. Description of the Related Art

Notaries Public provide notarial and authentication services to the general public and in numerous industries such as banking, real estate closings, employment, and other industries requiring verification of identity and signature witnessing. Generally, a Notary Public (also referred to as a "Notary" or "public Notary") is a public officer constituted by law to serve the public in non-contentious matters usually concerned with estates, deeds, powers-of-attorney, and foreign and international business. A Notary Public's main functions are to serve the public as an impartial witness in performing a variety of official acts related to transactions and signing of important documents such as which grant powers of attorney, convey interest in real estate, and other documents. A Notary's duty is to screen a signer's identity, their signing without duress or intimidation, and their awareness of the transaction or contents of the document being signed. The Notary may administer oaths and affirmations, take affidavits, and statutory declarations, witness and authenticate the execution of certain classes of documents, such as, for example, take acknowledgments of deeds and other conveyances, protest notes and bills of exchange, provide notice of foreign drafts, prepare marine or ship's protests in cases of damage, provide exemplifications and notarial copies, and perform certain other official acts depending on the jurisdiction. Any such act is known as a notarization or a notarial act.

Typically, there are multiple methods of identification presented to a Notary Public and extensive titles of documents a Notary Public records. Recording such data and information can be time consuming as documents, acts, and services must be substantially written in a Notary journal. For example, some Notary journals have record entries containing a box that can be quickly checked for an Acknowledgement or Oath but do not contain a box to quickly check the type of identification method presented by a signer/affiant, such as driver's license, tribal card, or credible witness, or for quickly checking a box for a specific title of the type of document being notarized, such as a Power of Attorney, bill of sale, contract, last will and testament, etc., or have an acronym reference list which can assist a Notary Public to record such more quickly. Additionally, for the purposes of signature authentication, a Notary Public verifies a signature of a signer/affiant with a signature on the identification method presented to a Notary Public by a signer/affiant before a document can be officially notarized, recorded, and/or have legal effect. In many states and countries, a citizen utilizing the services of a Notary Public sign within a record of a Notary Public's journal (also referred to as book, logbook, book of notarial acts, journal of notarial acts, or record book). The Notary Public must be reasonably satisfied that the identification presented is authentic, valid, unexpired, and matches the signer/affiant. That determination may be made by multiple methods including comparing and/or matching a signer/affiant's signature made in a Notary Public's journal, with and/or against the identification presented by a signer/affiant; by visual inspection of physical data, photograph, and signatures shown on an identification method presented by a signer/affiant; by the physical appearance; by comparing and/or matching relevant information and/or signatures on other documents and records; by usage of credible witnesses; and other law-regulated or best practice guidelines and procedures.

Historically, a Notary journal consists of a bound book. The type of Notary journal may be governed by state laws but generally must be well-bound. The term well-bound, is not generally specific, however, when referring to a Notary journal, it is oftentimes assumed in reference to prevent fraud, tampering with the contents of a journal, and having journal and content integrity, generally meaning the condition of being unified, unimpaired, or of sound construction and the state of being whole and undivided. Often, notarial acts and events are recorded in a Notary journal in exact numerical and sequential order. The bound book includes line item information records for data entry that contain, for example, information regarding the type of document notarized, a signer/affiant, a place for a signer/affiant's signature. Data entered regarding a signer/affiant may include personal, private, NonPublic Personal Information (NPPI or NPI) such as their name, address, driver's license number, date of birth, fingerprint, etc. Information specific to a signer/affiant may also include the nature of a signed or notarized document which may reveal private, personal, confidential, nonpublic, intellectual property, or secret information. A Notary Public enters signer/affiant information into a Notary journal and upon examination and verification of the identification presented for authenticity and accuracy of identity, a Notary Public may then turn a Notary journal and present it to the signer/affiant for their signature and/or fingerprint (generally a thumbprint).

Typically, a bound book may contain any number of pages. Notary Journals, for example may contain about 60-150 pages with each page including up to eight to eighteen information records. A Notary journal is not configured to keep private information from the view of others or subsequent signers/affiants. When open, the bound book may reveal approximately seven to seventeen records containing private information. For example, a signer/affiant that places their signature or fingerprint for identification verification on line seven of a book is able to see information records for the previous six signers/affiants, and a signer/ affiant on line 14 is able to view information records for the previous 13 signer/affiants. Thus, NPPI and other signer/affiant information is exposed.

Notaries, for example are professionals and generally state commissioned officials who are guided by standards, principals, and/or laws that include protecting private, non-public, personal information. This includes concealing information and prior signer/affiant information already entered in a journal from the general public, current signer/affiants, clients, or others, and while a journal is in usage, being viewed or reviewed, during data entry, and when verifying the identification of a signer/affiant, and/or presenting a journal for a signature or fingerprint for authentication.

Thus, Notaries Public have used Notary journals with such binding systems and methods as library binding, edition binding, publisher binding, standard binding, Smyth-sewn binding, glued binding, and other similar bindings, which do not generally lay flat when open, do not allow pages to substantially turn through 360 degrees, do not conceal information records or data regarding a title or contents of a Notary journal.

Notaries Public have attempted to conceal NPPI in such bound journals using a sheet of paper or with a folder as in U.S. Pat. No. 7,946,552B1 which is a type of substantially opaque privacy folder sleeve which can be slid or placed around a page to cover any portion of a page to prevent others and/or subsequent signer/affiant's from viewing data records, a previous signer/affiant's NPPI, and/or committing identity theft. A disadvantage of this type of covering device is that such device is oftentimes moved out of the way by a signer/affiant, inadvertently, and/or purposefully when signing the Notary Journal. Also, a Notary Journal will generally not lay flat when open due to a natural curvature of the bookbinding spine which can further complicate the use of the folder sleeve. Another disadvantage of such covering device is that the device may not stay where placed, if bumped, when moving the Notary Journal about, or when presenting the book to a signer/affiant to receive their signature, fingerprint, or for other reasons. A sheet of paper or folder tends to shift when a Notary turns and presents a Notary Journal to a signer/affiant for their signature and/or fingerprint. Additionally, many current Notary Journals can contain NPPI record sections for a single record on two facing pages of a journal which may require concealment of NPPI on two pages, simultaneously. In such Notary journals, the possibility of NPPI exposure can double and be twice as challenging to conceal. The sheet of paper or folder sleeve concealment approach may leave NPPI of prior signer/affiants exposed.

Notaries are not the only people, profession, or industry that seeks to conceal or protect private, personal, and/or nonpublic information, or prefer a bound plurality of papers which can lay flat when open, have fold back capabilities, along with security or integrity features, and spine label concealment. For example, hospitals and medical offices seek to comply with Health Insurance Portability and Accountability Act of 1996 (HIPPA) requirements, and scientists, accountants, corporations, businesses, government agencies, and others seek to reduce visibility of documents, records, data, private and/or NPPI such as medical information, records, log books, accounting ledgers, business journals, books, scientific records, top-secret documents, records, and data, and similar data or information from exposure or undesired or unauthorized exposure.

Generally, current systems and methods for binding a plurality of papers, stack of papers, sheets, leaves, pages, covers, books, notebooks, documents, or other stationery (collectively referred to as papers) can restrict or limit function, usability, or maneuverability, and/or not provide labeling concealment, security, integrity, or evidence of tampering of the binding and/or papers. Binding systems and methods, such as library binding, fine binding, edition binding, publisher binding, standard binding, metal binding, sewn binding, glued binding, tied binding, and/or other similar bindings, housings, or enclosures for a plurality of papers, are generally intended for frequent or non-frequent reading, usage, data retrieval, reference, handwritten entries, or notations. Current binding systems and methods for stacks of papers configured as for example, a book, notebook, data record, journal, accounting ledger, business journal, blank book, log or log book, scientific record, guest book, manifold book, day book, diary, portfolio, data record, Notary Public journal, Notary Public log book, Notary Public record book, government record, or medical record, file, document, form, or other stationery (collectively referred to as books) may not lay flat when open or allow pages to substantially turn through 360 degrees, conceal data regarding a title or contents, and can require to be held open to use. Other binding systems and methods, such as used in spiral binding, wire binding, coil binding, color coil binding, ring binding, or other similar bindings, housings, or enclosures, provide little security or evidence of tampering, if any, and can restrict and/or limit the use of the book.

A disadvantage of a spine binder, such as disclosed in U.S. Pat. No. 6,270,280, is that the spine allows for the easy insertion and removal of the sheets and does not lock securely, can be removed, pried open, is designed to be openable, and is non-locking which can allow a bound stack of sheets to be tampered with, or pages removed or inserted. Additionally, the spine binder of U.S. Pat. No. 6,270,280 has no system or method to provide an identifying label or spine label, tag, identification tag, identifier, identification marker, spine label, electronic identifier, Radio Frequency Identification (RFID) tag, electronic tag, electronic IDdentification (eID) tag, micro-chip tag, Unique Identifier (UID) tag, Personal Identifier (PID) tag, transponder, digital identifier, book spine poetry, book marker, and decorative tag (collectively referred to as a label) as to the title or contents, an identifying label or spine label which can also function as a place marker, or provide security for, or tamper-evidence of insertion or removal of pages of a bound plurality of papers or book.

A disadvantage of injection molded ring binders, such as one disclosed in EP0704322A2, is that they provide a method of removably binding a stack of sheets of paper. A stack of sheets of paper is inserted in a one-piece ring binder, wherein the rings are spread apart and opened using a machine for binding, then the rings, utilizing a spring mechanism force, closes and holds a stack of sheets of paper. This type of spine binder does not securely lock in place and is configured to allow removal of one or more pages and requires a binding machine to insert pages of paper, making binding and/or assembly costlier and/or inconvenient, and/or does not allow such bound material to turn through 360 degrees, since a spine of a binder substantially prevents bound pages from folding back neatly and usably upon itself.

Existing books that allow the pages to be removed or inserted lack a security feature that deters removal or insertion of pages, or provide evidence of tampering with the pages, or include an identifying label or spine label to reveal data regarding a title or contents of the book and wherein the identifying label or spine label also functions as a place marker. These features would allow the maintenance of the integrity of the book and/or pages of the book.

Thus, solutions are needed to solve these problems.

SUMMARY OF THE INVENTION

The aforementioned problems and other problems are reduced by systems and methods for providing security, integrity, binding, and labeling for a plurality or stack of papers and their covers, and for concealing the recording, viewing, or using private, personal, confidential, nonpublic, intellectual property, or secret information in accordance with the present invention.

In one embodiment of the present invention, the system provides for improving usability, function, maneuverability, integrity, labeling, and security for a plurality or stack of papers comprising a spine binder shaft having a posterior side and an bendable center axis, a first plurality of loop fasteners having a first end configured as a male connector connected to the posterior side of the spine binder shaft, and a second plurality of loop fasteners having a first end connected to the posterior side of the spine binder shaft configured as a female connector and configured to receive and engage the male connector of the first plurality of loop fasteners to form a cooperating pair of loop fasteners that close and lock to bind a stack of papers. When closed the spine binder shaft, first plurality of loop fasteners, and second plurality of loop fasteners form a continuous unreleasable unit and when the first and second plurality of loop fasteners are closed flush, a bound plurality of papers can rotate substantially 360 degrees to fold back upon itself and lie flat when open.

In another embodiment of the present invention, the system provides for improving usability, function, maneuverability, integrity, labeling, and security for a plurality or stack of papers and their covers comprising a plurality or stack of papers, a binding device to secure the plurality or stack of papers wherein the bound stack of papers can rotate substantially 360 degrees to fold back upon itself and lie flat when open, and a tamper-evident security device wherein upon closing the binding device, the tamper-evident security device prevents removal and insertion of a page without evidence of tampering.

In yet another embodiment of the present invention, the system comprises a covering device for releasably covering, providing security, and concealing personal, private, and nonpublic information including a plurality of magnetic repositionable strips and a magnetic repositionable sheet and wherein the magnetic repositionable strips are sized to adhere to and cover personal, private, and nonpublic information and the magnetic repositionable sheet is at least sized to adhere to the plurality of magnetic repositionable strips.

In another alternative embodiment of the present invention, the system comprises a covering device for releasably covering, providing security, and concealing personal, private, or nonpublic information on a page of an open plurality of pages including a plurality of repositionable strips magnetized on a first side and a second side forming double magnetized repositionable strips and a sheet magnetized on a first side and a second side of the sheet forming a double magnetized sheet with both sides of the double magnetized sheet are configured to receive and releasably adhere to both sides of the double magnetized repositionable strips, and a connecting component configured to connect the double magnetized sheet to the double magnetized repositionable strips, wherein the double magnetized repositionable strips are sized to adhere to and cover the personal, private, and nonpublic information.

In another embodiment of the present invention, the system comprises a covering device for providing security for, reducing exposure, covering, protecting, or concealing personal, private, and nonpublic information comprising a folder sleeve having a first face and a second face, the first face having a substantially opaque exterior side and an interior side having at least one magnetic component or border and the second face having an interior side having at least one magnetic interior component or border, and wherein the first face and the second face forming the folder sleeve such that the folder sleeve can secure the contents of the folder or can slip over two sides and a corner of a page and releasably magnetically join the magnetic components or border edges to secure the folder sleeve where positioned.

In another embodiment of the present invention, the system comprises a covering device for releasably providing security for, reducing exposure, covering, protecting, or concealing personal, private, and nonpublic information including at least one or a plurality of a substantially opaque repositionable adhesive strips having a first edge and at least one or a plurality of non-adhesive handling tabs configured to extend from the first edge of the substantially opaque repositionable adhesive strip, wherein the substantially opaque repositionable adhesive strip is configured to cover personal, private, nonpublic information and configured for repositioning.

In another embodiment of the present invention, a method for covering, protecting, or concealing personal, private, and nonpublic information on a paper or page including personal, private, and nonpublic information comprising the steps of positioning a magnetic sheet covering device behind a paper or page of personal, private, nonpublic information, positioning a magnetic strip covering device over personal, private, nonpublic information located on the paper or page, releasably securing the magnetic strip covering device over personal, private, nonpublic information to be covered on the paper or page, exposing other information, blank spaces, or information fields on a paper or page, entering data on the exposed area on the page or on a blank information field as necessary or preferred, and upon completion of entering data, allowing the magnetic strip covering device to remain in place covering information on the paper or page or releasing the magnetic strip covering device and magnetic sheet covering device for subsequent use.

In another embodiment of the present invention, a method for covering, protecting, or concealing personal, private, nonpublic information on a paper or page including personal, private, and nonpublic information, comprising the steps of positioning a double magnetized covering device that is bound and connected by a binding device to a plurality of double magnetized strips, wherein the double magnetized strips are magnetically situated on a second side of the double magnetized sheet. A first side of the double magnetized sheet is placed under a paper or page having personal, private, nonpublic information located on the paper or page. Rotating one or more of the double magnetized strips from the second side of the double magnetized sheet and positioning the double magnetized strip over the personal, private, nonpublic information located on the paper or page. Releasably securing the double magnetized strip over personal, private, and nonpublic information on the paper or page to be covered. Exposing information and blank information fields on the paper or page, entering data on an exposed area on the paper or page or on a blank information field on the paper or page as necessary or preferred, continuing to enter data as needed until all double magnetized strips have been rotated to cover the personal, private, and nonpublic information. Allowing the double magnetized strips and the double magnetized sheet to remain in place covering information on the page or releasing the double magnetized strips and the double magnetized sheet for subsequent use over other information or papers. Releasing and removing the connected double magnetized strips and the double magnetized sheet away from the paper or page. The double magnetized strips can remain on the first side of the double magnetized sheet and the connected double magnetized strips and double magnetized sheet unit can be rotated horizontally for reuse or the double magnetized strips can be rotated back to the second side of the double magnetized sheet for future use.

In accordance with another embodiment of the invention is a system for providing security for, evidence of tampering, and covering, protecting, and concealing personal, private, and nonpublic information comprising a plurality or stack of papers, a binding device configured to connect, secure, and bind the plurality of papers such that the bound plurality of pages can substantially rotate 360 degrees and can fold back upon itself and lie flat when open, a covering device configured to cover the personal, private and nonpublic information, and a tamper-evident device such as an indicative seal, barrier seal, security seal, security sticker, plastic seal, metal seal, adjustable length seal, banking seal, fixed seal, bolt seal, screw seal, security ring, locking seal, padlock seal, Radio Frequency Identification (RFID) tag, electronic IDdentification (eID) tag, microchip tag, Unique Identifier (UID) tag, Personal Identifier (PID) tag, transponder, and digital identifier (collectively referred to as a security seal) inserted in at least one combining hole of a plurality of papers or attached to at least one combining loop and configured to deter or prevent removal or insertion of one or more papers or pages in the bound plurality of papers.

BRIEF DESCRIPTION OF THE DRAWINGS

The invention will be readily understood by the following detailed description in conjunction with the accompanying drawings, wherein like reference numerals designate like structural elements, and in which:

FIG. 4A shows a side view of a loop fastener pair of a locking spine binder for use with a system for providing security, binding, and labeling for a plurality of papers and their covers, according to one embodiment of the present invention;

FIG. 4B shows a side view of an alternative loop fastener pair of a locking spine binder shown in FIG. 4A for use with a system for providing security, binding, and labeling for a plurality of papers and their covers, according to one embodiment of the present invention;

FIG. 4C shows an exemplary view of an alternative punch and bind spiral binding device shown in FIGS. 4A and 4B for use with a system for providing security, binding, and labeling for a plurality of papers and their covers, according to one embodiment of the present invention;

DETAILED DESCRIPTION OF THE INVENTION

The present invention provides systems and methods for providing security, binding, and labeling for a plurality of papers or books and covering, protecting, and concealing private and nonpublic information while viewing, using, data entry, and/or recording information, such as, for example personal information.

Figure 1:
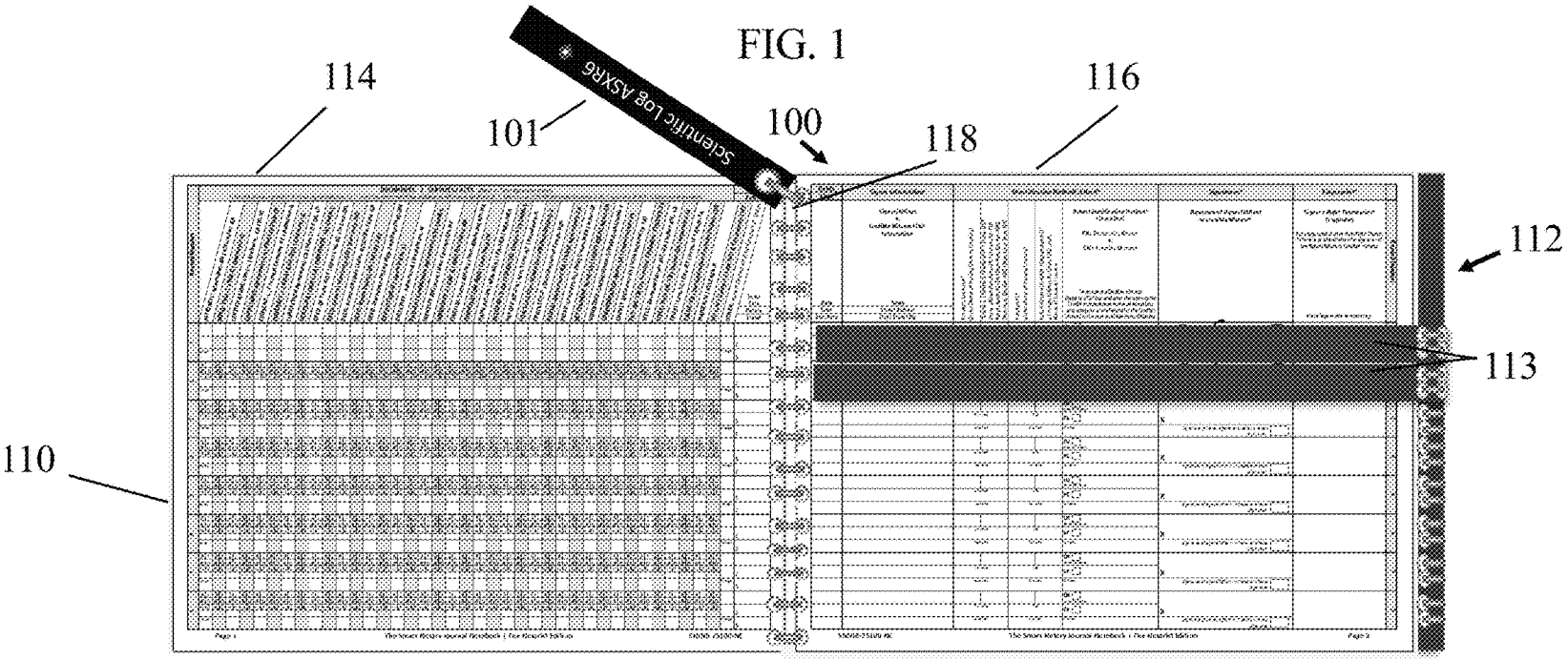
FIG. 1 shows an exemplary view of a system for providing security, binding, and labeling for a plurality of papers and their covers, and covering, protecting, and concealing the recording, viewing, or using of personal, private and nonpublic information on the pages.

FIG. 1 is an exemplary view of a system 100 for providing security, binding, and labeling for a plurality of papers and their covers, and covering, protecting and concealing the recording, viewing, or using of personal, private, and nonpublic information on the pages, in which an embodiment of the present invention may be implemented. The system 100 comprises a bound plurality of papers and their covers, 110 (also referred to as a book or journal) that includes multiple pages (only two pages shown), a covering device 112 and a binding device 118. The book 110 further comprises a first side 114 (or page) and a second side 116 (or page). The first side 114 and the second side 116 of the book 110 are bound together with the binding device 118. In a preferred embodiment, the binding device 118 comprises a tamper-evident combining device configured to be non-removable configured to cooperate with the first side 114 and second side 116 of the book 110 such that the book 110 lies flat when opened or folded back on itself. In another embodiment, the binding device 118 comprises a spiral binding device configured to be unreleaseable (see FIGS. 4A-4C) and configured to cooperate with the first side 114 and second side 116 of the book 110 such that the book 110 lies flat when opened or folded back on itself. In another embodiment, the binding device 118 comprises an adhesive such as, for example, glue that binds the multiple pages of the book 110. In another embodiment, the book 110 comprises an identification label 101 or an identifying label or spine label, tag, identification tag, identifier, identification marker, spine label, electronic identifier, Radio Frequency Identification (RFID) tag, electronic tag, electronic IDdentification (eID) tag, microchip tag, Unique Identifier (UID) tag, Personal Identifier (PID) tag, transponder, digital identifier, book spine poetry, book marker, and decorative tag (collectively referred to as a label) which can be used as a place marker configured to attach the label to the binding device 118 and at least one loop fastener (shown in detail in FIGS. 3A-3C). In another embodiment, book 110 identification label 101 configured to attach the label to at least one loop of a punch and bind binding (not shown).

In an embodiment, the covering device 112 further comprises magnetic repositionable strips 113 configured to releasably cover information on the first side 114 and/or second side 116 of the book 110.

Figure 1A:
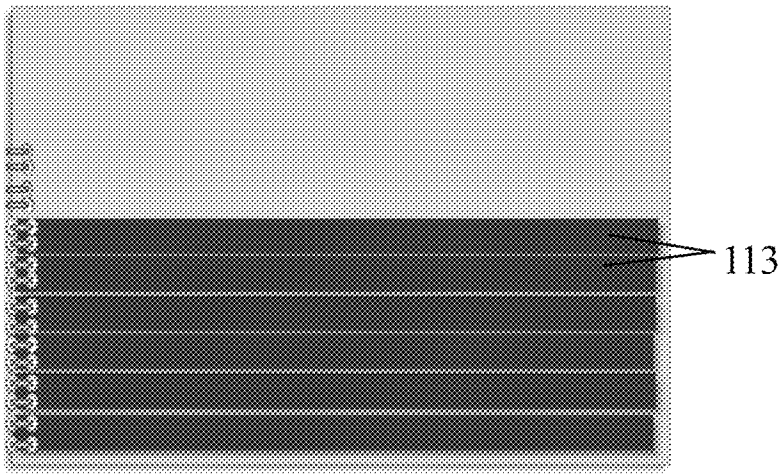
FIG. 1A shows a detailed view of the covering device of the system shown in FIG. 1.

FIG. 1A shows a detailed view of the covering device 112 shown in FIG. 1 with magnetic repositionable strips 113.

In FIG. 1 for illustrative purposes, the covering device 112 is only shown on the second side 116 of the book 110. The magnetic repositionable strips 113 are configured such that private, and/or completed information is not visible to unauthorized viewers and/or a subsequent viewers or signer/affiant and/or while viewing, usage, data entry, and/or recording information, thereby reducing visibility and exposure of private, personal, or nonpublic information.

Figure 2A:
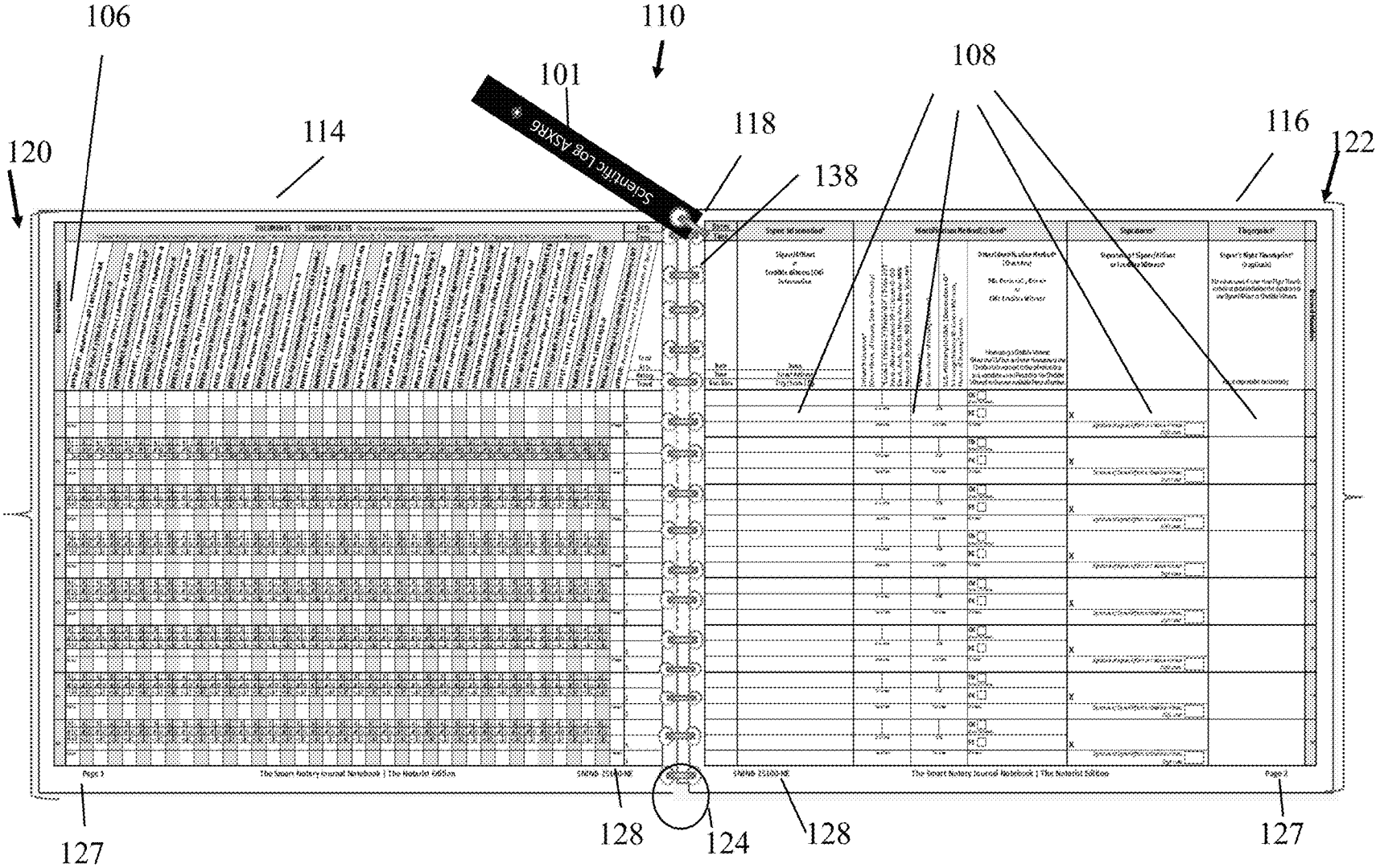
FIG. 2A shows an exemplary view of a journal for use with a system for providing security, binding, and labeling for a plurality of papers and their covers, and covering, protecting, and concealing the recording, viewing, or using of personal, private, and nonpublic information on the pages, according to one embodiment of the present invention.

FIG. 2A shows an exemplary book 110 for use with a system for providing security, binding, and labeling for a plurality of papers and their covers, and covering, protecting, and concealing the recording, viewing, or using of personal, private, and nonpublic information on the pages. In an embodiment, the book 110 includes private information and/or information records 120 on the first side 114 of the book 110 and private, nonpublic, identity, signature authentication information, and/or records 122 on the second side 116 of the book 110. The information and/or records 120 can include private, personal, confidential, nonpublic, intellectual property, or secret information such as, for example, government information, medical information, scientific log information, top-secret information, and/or private information. In an embodiment, the information records 120 are configured with headings that describe each section of the information and/or records 120 and individual information sections and/or lines. In an embodiment, for example, the information and/or records 120 may include a record number, space for inserting a date, time, and document date, document type or service type, fees, acts and/or other information. Another embodiment of the information records 120 may provide space to indicate the service provided, an Acknowledgment (A), Jurat (J) indication, Loose Certificate attached (L) or Duplicate document served (DUP), a service statement to acknowledge an Affirmation (AF) or Oath (O) administered, and notes. In an embodiment, for data entry efficiency, the document or service type on the information record 120 may include selections such as a document types list 106 from often used documents or service types. For example, the document or service type may include, but are not limited to, a selection from a list comprising the following: Affixation Affidavit; Auto: Title, VIN, Odometer; Certificate: Authorization; Compliance Agreement; Consent, Parental Consent, Adoption; Contract, Bill of Sale; Copy Certification; Correction Agreement; Deed: Warranty, General Warranty, Quit Claim; Deed: Home Equity, Home Equity Line of Credit, Second Mortgage; Deed: of Trust, Open End, Mortgage; Deposition, Swearing In; Directive: Advance, Healthcare; Errors and Omissions, Compliance Agreement; Identity Affidavit; Marital Status Affidavit; Modification, Loan Modification; Name Affidavit, Also Known As (AKA); Obligation of Debts Affidavit; Occupancy, Financial Status, Combined; Payoff Affidavit, Termination Affidavit; Power of Attorney: Limited, Durable, Non-Durable, Medical, Springing; Proceeds, Distribution of Funds; Rental Agreement, Lease; Shortage(s) Agreement; Signature Affidavit, Signature/Name Affidavit; Subordination Agreement; Survey Agreement; Tax Indemnity; Title Affidavit, Owner Affidavit, Seller Affidavit; Trust: Certification, Revocable, Irrevocable, Amendment; Value Affidavit, Consideration of Value; Waiver, Release; Will, Living Will, Last Will and Testament; Other (List Document, Service, and Statement Type Beneath Appropriate Type and/or in Notes). For illustration purposes, only the four document or service types are shown on the first side 114 of the journal 110; however, a journal 110 may include each of these, a list of other document or service types, and/or an acronym reference guide. Each information record 120 corresponds to an associated signature authentication record 122.

In an embodiment, signature authentication records 122 are configured to include headings that describe each section of the authentication record 122 and space for the signer/affiant to provide the required information. The signature authentication record 122 may include signer/affiant information, identification methods used, signatures, or fingerprints and the same record number listed on the information record 120. In an embodiment, the signer/affiant information 108 comprises the signer, affiant, or credible witness' information such as name, street address, city, state, and zip code. In an embodiment, the identification methods presented and/or used may include driver's license, local, state, federal identification, passport, United States military identification, or other identification method, such as the signer/affiant was personally known or via credible witness. The signature authentication record 122 includes the signature of signer/affiant, affiant, or credible witness, and/or the signer/affiant's thumb or finger print.

In an embodiment, the book 110 includes a plurality of information records 120 on the first side 114 of the book 110 and an associated plurality of private, personal, confidential, nonpublic, intellectual property, or secret information, identity, and/or signature authentication records 122 for a single record on the second side 116 of the book 110. In an alternative embodiment, the journal 110 includes eight information records 120 on the first side 114 of the journal 110 and eight associated records for identity verification and/or signature authentication 122 on the second side 116 of the journal 110.

Pages of the book 110 should not be inserted and/or removed to maintain the integrity of the book 110, information records 120, 122, identification, and signature authentication process. A tamper-evident security device 124 (see FIG. 2A) configured to cooperate with the binding device 118 serves to prevent tampering with the contents of the book 110 such as for example, the removal of pages from the book 110 by prohibiting the removal of the binding device 118. Further, the binding device 118 can include an identification label 101.

In addition, the binding device 118 is configured to allow the book 110 to lay flat, and/or fold back upon itself, and further configured to be remain closed, be tamper-evident, and configured to be unreleasable. In an alternative embodiment, the tamper-evident security device is configured to or as a punch and bind spiral binding 160 (see FIG. 4C), coil binding, color coil binding, wire binding, metal binding, and other similar binding, housing, enclosure.

In alternative embodiments, the tamper-evident security device comprises such as, for example, a sealed strip or security seal attached to the binding device 118 and/or through at least one combining hole 138 of the plurality of papers and their covers. In another alternative embodiment, pages of the book 110 comprise tamper-evident security features such as, for example, pantograph paper, erasure resistant paper, coin-reactive ink, thermochromic ink, microtext print, bar codes, or radio frequency identification tags in pages of the journal inserted, attached to or part of a page of the book 110 with specific identifiable colors, numerical combinations, custom markings, warnings, labels, tracking history, records, or other data embedded, printed, or attached in or to the book 110 for determining that the book 110 has been tampered with. In an alternative embodiment, the book 110 includes consecutive page numbers 127 on each side 114, 116 of the book 110 that serve as a visual indicator as to whether or not the book 110 has been tampered with or pages removed or replaced. In addition, the book 110 may include a special code or identifier 128 on each page of each side 114, 116 of the book 110 as an indication of association of that page with that book 110.

Figure 2B:
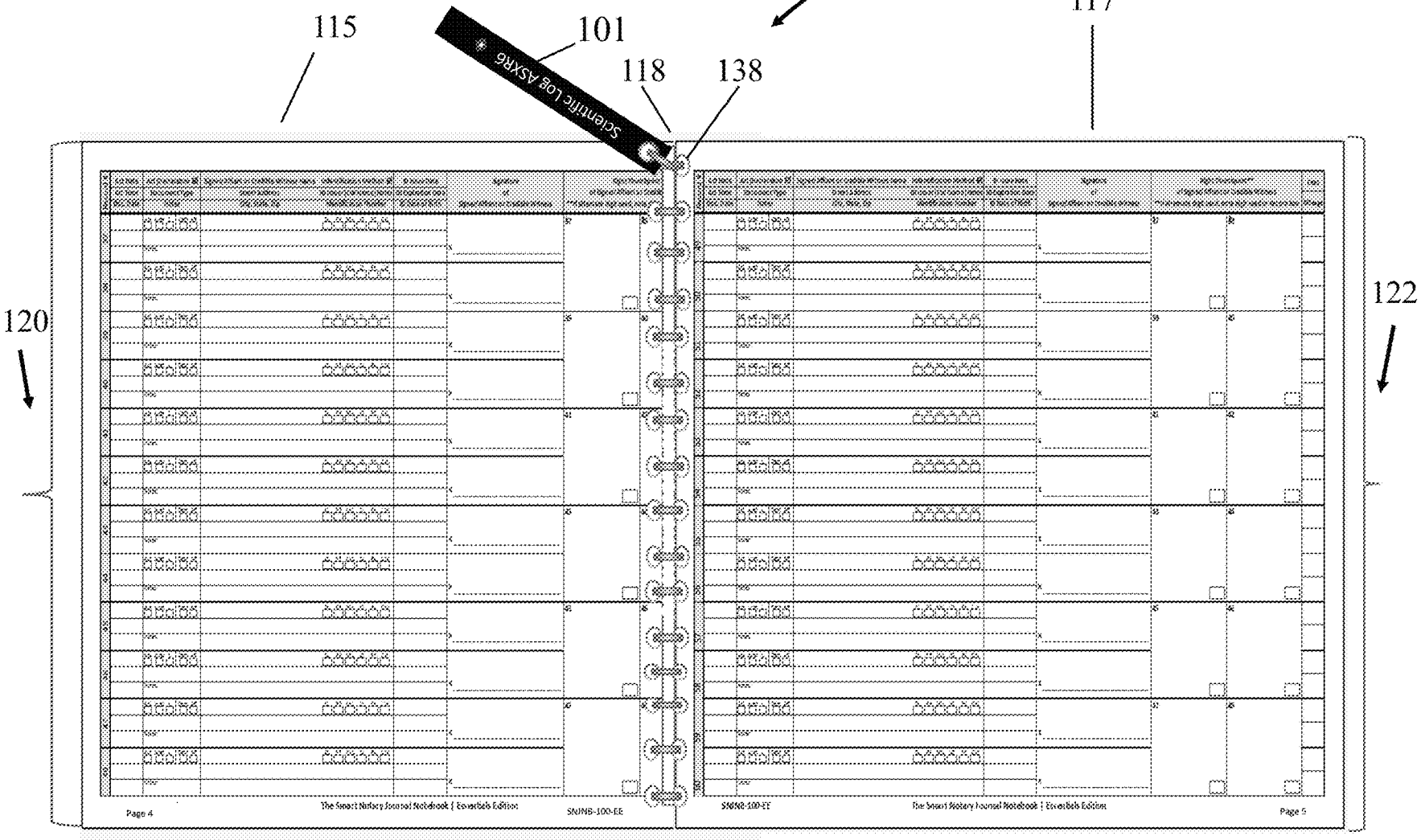
FIG. 2B shows an exemplary view of an alternative journal for use with the system for providing security, binding, and labeling for a plurality of papers and their covers, according to one embodiment of the present invention.

FIG. 2B shows an exemplary view of an alternative book 111 for use with a system for providing security, binding, and labeling for a plurality of papers and their covers, according to one embodiment of the present invention. In an alternative embodiment, the first side 115 of the book 111 and the second side 117 of the book 111 includes both the private information and/or information records 120 and signature authentication records 122.

Figure 3A:
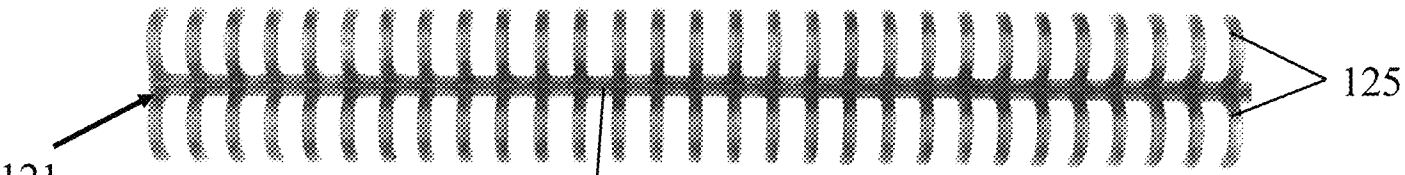
FIG. 3A shows an exemplary posterior view of a locking spine binder for use with a system for providing security, binding, and labeling for a plurality of papers and their covers, and covering, protecting, and concealing the recording, viewing, or using of personal, private, and nonpublic information on the pages, according to one embodiment of the present invention.

FIG. 3A shows a posterior view of the binding device 118 of the book 110 configured as a locking binding device 119 (also referred to as locking binding spine, un-releasable spine binder, or spine locking or binding device). The locking binding spine 119 includes a generally rectangular shaft 121 having a bendable center axis 123 and a plurality of open loop fastener pairs 125 movably connected to the shaft 121 such that the loop fastener pairs 125 are substantially parallel and opposite to each other. In a preferred embodiment, the center axis 123 on the shaft 121 is bendable and the shaft 121 includes a plurality of loop fastener pairs 125 located opposite each other and connected to the shaft 121 that mate allowing the loop fastener pairs 125 on the shaft 121 to close, lock, and are substantially flush when joined, forming a convolution and/or loop, wherein the shaft 121 and plurality of loop fastener pairs 125 secure and bind a plurality of papers and their covers, and allow the combined (or bound) papers to substantially rotate up to 360 degrees when the locking spine binding 119 is closed. In an embodiment, the loop fastener pairs 125 each substantially form an arc, circle, "D-shaped," or hemi circle shape. In addition, the locking binding spine 119 secures and/or binds a plurality of papers and their covers (or book), provides a deterrent to tampering, and tamper-prevention, evidence of tampering, integrity, and security for a plurality of papers, and its contents, covers, binding, and enclosure, once secured, combined, or closed. The locking binding spine 119 and shaft 121 can be comprised of materials such as and including plastic, metal, wood, leather, fabric, steel, tin, vinyl, precious metal, stone, cord, carbon fiber, resin, graphene, synthetic elastomer, fiberboard, poly, acrylic, acrylic glass, plexiglass, bio-plastic, eco-plastic, polyester, rubber, and silicone. The locking binding spine 119 may include one or more identifying information such as marks, watermarks, letters, designs, numbers, sequential and/or random numbers, book's title, author, publisher, logo, contents information, and/or other identifiable components (also referred to as indicia) on the shaft 121 (not shown). The book identifying label 101 (shown in FIGS. 1, 2A, 2B, and 6) may be configured in a plurality of shapes such as rectangular, square, circular, geometric, and made of a plurality of materials such as and including, but not limited to plastic, metal, paper, silk, wood, cardboard, leather, fabric, ribbon, felt, steel, tin, vinyl, precious metal, stone, cord, foil, carbon fiber, resin, graphene, synthetic elastomer, fiberboard, poly, acrylic, acrylic glass, plexiglass, bio-plastic, eco-plastic, polyesters, silicone, rubber, and cardstock, the label further including indicia such as a mark, letter, number, sequential number, watermark, bar code, author, title, logo, publisher, trademark, brand, decoration, price, picture, descriptor, category, lettering, clip art, image, design, graphic, Uniform Product Code (UPC), website, endorsement, International Standard Book Number (ISBN), Radio Frequency Identification (RFID), electronic identification (eID), Unique Identifier (UID), transponder, and microchip (collectively referred to as indicia) with information regarding the bound stack of which can also be used as a place marker inside a bound plurality of papers or book, and/or which can be attached adhesively or magnetically, to the locking spine binder 119, the punch and spine spiral binding 160 (shown in FIG. 4C), or an editable spine binder (not shown). Alternatively, the identifying label 101 can be attached utilizing mechanisms including but not limited to wire, ribbon, rope, string, security seal, magnetic seal, ring, single loop fastener pair 125, and/or similar connecting mechanism, wherein the identifying spine label 101 can hang freely from the locking spine binder 119, spiral binding 161 (shown in FIG. 4C), or editable spine binder (not shown) which can allow the identifying spine label also be used as a place marker.

Figure 3B:
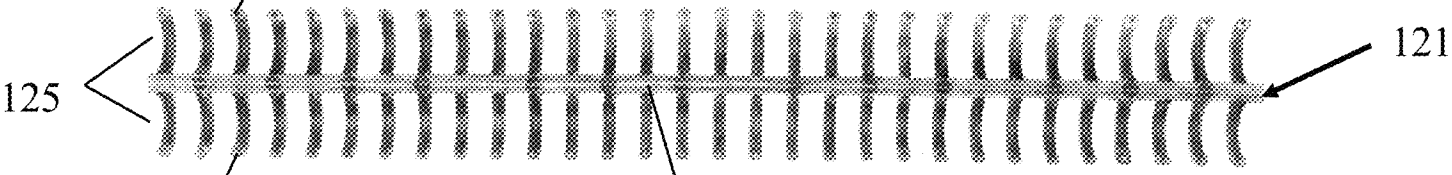
FIG. 3B shows an exemplary anterior view of the locking spine binder of FIG. 3A for use with a system for providing security, binding, and labeling for a plurality of papers and their covers, and covering, protecting, and concealing the recording, viewing, or using of personal, private, and nonpublic information on the pages, according to one embodiment of the present invention.

FIG. 3B shows an exemplary anterior view of the locking spine binder 119 of FIG. 3A for use with a system for providing security, binding, and labeling for a plurality of papers and their covers, and covering, protecting, and concealing the recording, viewing, or using of personal, private, and nonpublic information on the pages, according to one embodiment of the present invention. The locking binding spine 119 includes the generally rectangular shaft 121 having a center axis hinge 123 and the plurality of open loop fastener pairs 125 movably connected to the shaft 121 such that the loop fastener pairs 125 are substantially parallel and opposite to each other.

FIG. 3B shows the loop fastener pairs 125 each having male 133 and receiving female 135 connectors (also referred to as fasteners). The male connector 133 may comprise a slit in a head or tip, a compressible center channel (shown in FIG. 4A), or at least two compressible tabs (shown in FIG. 4B) of the male connector 133 to allow the head, tip, channel, or tabs to bend or compress and insert in the female connector 135 causing a cavity rim (shown in FIGS. 4A and 4B) of the female connector 135 to receive and unrelease the male connector 133.

Figure 3C:
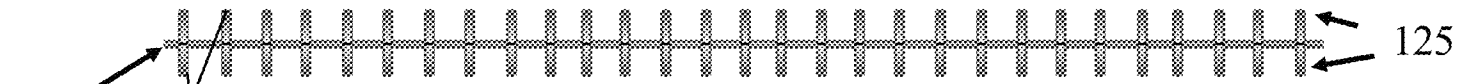
FIG. 3C shows an exemplary view of a closed locking spine binder of FIGS. 3A and 3B for use with a system for providing security, binding, and labeling for a plurality of papers and their covers, and covering, protecting, and concealing the recording, viewing, or using of personal, private, and nonpublic information on the pages, according to one embodiment of the present invention.

FIG. 3C shows an exemplary view of a closed locking spine binder 119 of FIGS. 3A 3B for use with a system for providing security, binding, and labeling for a plurality of papers and their covers, and covering, protecting, and concealing the recording, viewing, or using of personal, private, and nonpublic information on the pages, according to one embodiment of the present invention. In FIG. 3C, the plurality of loop fastener pairs 125 connected to the shaft 121 and each pair 125 having male connector 133 and female connector 135 have been pushed together with its opposite half to form a closed convolution and/or closed loop 131. In a preferred embodiment, the locking binding spine 119 is configured to remain closed.

FIG. 4A shows side view of a loop fastener pair 125 for use with a system for providing security, binding, and labeling for a plurality of papers and their covers, according to one embodiment of the present invention. The loop fastener pair 125 is shown in an open configuration. The loop fastener pair 125 comprising the male connector 133 and the female connector 135 is connected to the bendable shaft 121. The male connector includes a tip, head, and/or shank 137. In an embodiment, the shank 137 is configured as having a head with compressible tabs. In an embodiment, the shank 137 comprises a substantially enlarged rimmed head. A corresponding female connector 135 comprising a rimmed chamber or cavity 139 and can be ribbed and configured to receive and catch the shank 137 or head to close and lock the loop fastener pair 125. When closed, the locking spine binder 119 allows the bound pages to lie flat when opened, rotate substantially through 360 degrees, fold back upon itself, and deters removal of pages without evidence of tampering, damaging, disfiguring, and/or affecting the attractiveness of the binding device once secured, combined, and/or closed.

FIG. 4B shows side view of an alternative loop fastener pair 125A for use with a system for providing security, binding, and labeling for a plurality of papers and their covers, according to one embodiment of the present invention. In an alternative embodiment shown in FIG. 4B, the male connector 133 is configured having a head configured as a compressible channel 153. The corresponding female connector 135 comprising a rimmed chamber or cavity 139 and can be ribbed and configured to receive and catch the shank 137 or head configured as a compressible channel 153 to close and lock the loop fastener pair 125.

FIG. 4C shows an alternative punch and bind spiral binding device for use with a system for providing security, binding, and labeling for a plurality of papers and their covers, according to one embodiment of the present invention. The punch and bind spiral binding device is configured as a spiral binding 160 with each end 161 having a male connector head 162 or 163. In an embodiment, the end 161 comprises a male connector head with compressible tabs 162. In an alternative embodiment, the end 161 comprises a male connector head with a compressible center channel slit in a head or tip 163. The end 161 of the spiral binding 160 is configured to connect to a separate female connector bead 164 that is sized larger than a combining hole 138 and includes a bead with a rimmed chamber cavity 165. The female connector bead 164 is configured to attach to the male connector ends 161 to allow the male connector heads 162 or 163, to bend or compress and insert into the rimmed chamber cavity 165 of the female connector bead 164 causing a cavity rim of the female connector bead 164 to receive and unrelease the male connector head 162 or 163 on the male connector ends 161 of the spiral binding 160, wherein the female connector bead 164 is un-releasably attached to the male connector head 162 or 163 of the spiral binding 160 to prevent removal of the spiral binding 160.

In an embodiment, the female connector comprises a bead 164 having a rimmed chamber cavity 165 selected from the group consisting of ball, square, rectangle, cube, oval, cabochon, marquise, baroque, barrel, polygon, octagon, geometric bead, and tab, and comprising material selected from the group consisting of plastic, metal, wood, leather, fabric, steel, tin, vinyl, precious metal, stone, bone, clay, glass, porcelain, crystal, ceramic, glass, carbon fiber, resin, graphene, synthetic elastomer, gemstone, poly, acrylic, acrylic glass, plexiglass, bio-plastic, eco-plastic, polyesters, silicone, rubber, rubber, and silicone, and sized larger than a combining hole 138.

In a preferred embodiment, the spiral binding device 160 is formed to bind a plurality of papers and their covers, wherein the pages can rotate 360 degrees to fold back upon itself and lie flat when open and includes tamper-evident security features 162, 163, and 165. In an alternative embodiment, a tamper-evident security seal such as an indicative seal, barrier seal, security seal, security sticker, plastic seal, metal seal, adjustable length seal, banking seal, fixed seal, bolt seal, screw seal, security ring, locking seal, padlock seal, Radio Frequency Identification (RFID) tag, electronic IDdentification (eID) tag, microchip tag, Unique Identifier (UID) tag, Personal Identifier (PID) tag, transponder, and digital identifier, (collectively referred to as security seal) (not shown) is inserted through one or more combining holes 138, or a tamper-evident security device attached to a closed binding device loop 131. Alternatively, to provide security and integrity to spiral binding 160 a coil, wire, and/or comb binding (not shown) is attached to each end 161 of the spiral binding 160, and/or inserted in at least one combining hole 138, so that pages cannot be removed without cutting the binding or being tamper-evident. In an embodiment, the binding device 118 (or locking spine binder 119 shown in FIGS. 3A-3C or spiral binding 160 shown in FIG. 4C) comprises a thin plastic strip configured to spiral through at least one combining hole 138 of the plurality of papers of the book 110.

Figure 5:
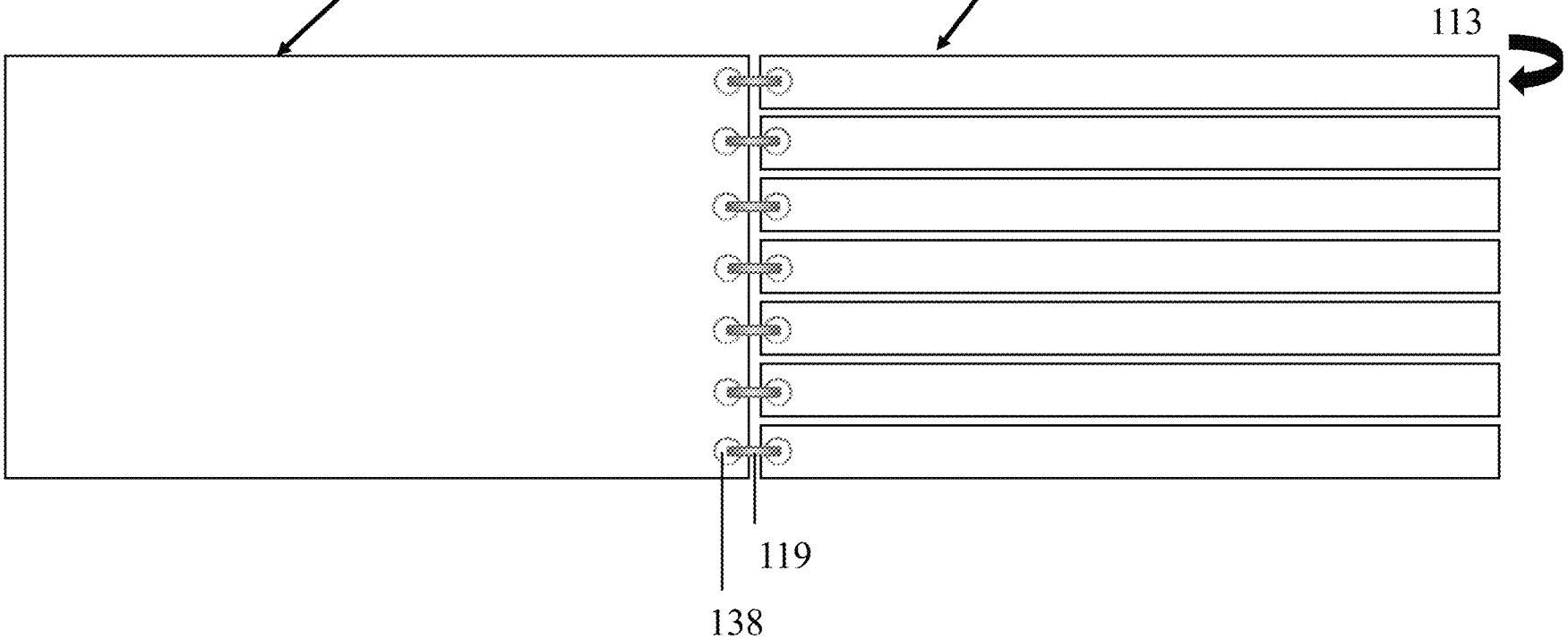
FIG. 5 shows an exemplary view of a covering device for use with systems and methods for providing security, binding, and labeling for a plurality of papers and their covers, and covering, protecting, and concealing the recording, viewing, or using of personal, private, and nonpublic information on the pages, according to one embodiment of the present invention.

FIG. 5 shows an exemplary view of a covering device 112 for use with systems and methods for providing security, binding, and labeling for a plurality of papers and their covers, and covering, protecting, and concealing the recording, viewing, or using of personal, private, and nonpublic information on the pages, according to one embodiment of the present invention. The covering device 112 further comprises a first side 130 and a second side 132. In a preferred embodiment, the first side 130 and the second side 132 are connected with a combining device configured as a locking spine binder 119 to allow the covering device 112 to lay flat, and/or fold back upon itself, and configured to be non-removable without evidence, un-releasable, and to remain closed. In an alternative embodiment, other covering device connectors include for example, punch and bind spiral binding 160, editable spine binder, etc. that allow the covering device 112 to be bound yet lay flat when open and fold back upon themselves. To provide security and integrity to covering devices bound with punch and bind bindings and spiral bindings 160, 119, these type bindings are used in combination with a security feature such as a tamper-evident security seal inserted through at least one combining hole 138 of the plurality of papers and their covers. Alternatively, to provide security and integrity for punch and bind bindings the bindings include attaching a security device comprised as a bead 164 configured as a ball, square, rectangle, cube, oval, cabochon, marquise, baroque, barrel, polygon, octagon, tab, and/or other shape sized larger than a combining hole 138 to each end of the binding and configured to unrelease so that pages cannot be removed without cutting the binding or being tamper-evident once attached. In an embodiment, a security seal is inserted through at least one combining hole of the bound plurality of papers and their covers or a binding loop. The first side 130 and the second side 132 of the covering device 112 each include a plurality of holes 138 at the edge of each side 130, 132 for receiving the locking spine binder 119. In an embodiment, the locking spine binder 119 comprises a thin plastic strip configured to spiral through the holes 138 in each side 130, 132.

Preferably, the covering device 112 is double magnetized (magnetized on both sides of the material) such that the first side 130 is configured as double magnetized repositionable strips 113 and the second side 132 configured as a double magnetized sheet to attract the double magnetized repositionable strips 113 whereby the first side 130 remains in place and covers the second side 132 when the first side 130 is placed over the second side 132 yet the first side 130 is releasable on demand. Preferably, the double magnetized sheet and double magnetized strips are combined utilizing the spine binding device 119. In another embodiment, the double magnetized sheet 132 and corresponding double magnetized strips are utilized to cover information and/or records containing private, personal, confidential, nonpublic, intellectual property, or secret information such as, for example, a book title, newspaper title and/or article, magazine title or cover, page, note, material, notebook, file, form, accounting ledger, business journal, blank book, log, scientific record, guest book, sign-in sheet, record sheet, sign, billboard, easel paper, poster, book, general office stationery, manifold book, day book, diary, portfolio, or other stationary, etc. In an embodiment, the double-magnetized covering device comprises a magnetic sheet material, without vinyl and/or paper coating and, a plurality of magnetic sheet strips constructed of magnetic material, without vinyl and/or paper coating. In a preferred embodiment, the magnetic covering device 112 comprises a substantially opaque covering device. In an embodiment, the double magnetized sheet is configured as a full standard letter size sheet in a portrait orientation with corresponding double magnetized strips. In an alternative embodiment, the double magnetized sheet is configured as a full standard letter size sheet in a landscape orientation with corresponding double magnetized strips. In another embodiment, the double magnetized sheet is configured as a standard legal-size sheet in a landscape orientation with corresponding double magnetized strips. In another embodiment, the double magnetized sheet is configured in a landscape or portrait orientation in any size with corresponding double magnetized strips. In a landscape orientation, the covering device 112 covers a book 110 in an open position and a sheet size of approximately 6"×22" with the first side 130 measuring 6"×11" and the second side 132 measuring 6"×11." In an embodiment, the first side 130 include eight magnetic or double magnetized repositionable strips 113 with each magnetic repositionable strip 113 measuring approximately $10\frac{1}{16}$"×$10\frac{11}{16}$" with a distance between each magnetic repositionable strip 113 of approximately 2 mm. In the alternative embodiment where the covering device 112 comprises a single sheet adapted to fold in the center, an allowance for center bend is approximately 3 mm. In an embodiment, the magnetized covering device 112 has a portrait orientation for covering information. In a portrait orientation with the book 110 in an open position the covering device 112 comprises a sheet size of approximately 8"×11" with the first side 130 measuring 8"×11" and the second side 132 measuring 8"×11." In further embodiments, the magnetized covering device 112 may be single-side magnetized, double magnetized (magnetized on both sides), and may have any size and orientation (such as landscape) to cover information and/or cover information or embodiment on the book 110 or in an open or closed position according to the viewer or user's preference.

As shown in FIG. 5, in an embodiment second side 132 (also referred to as a left page) is configured as a solid sheet of double magnetized material and the first side 130 (also referred to as a right page) comprises corresponding double magnetized strips 113 and a locking spine binder 119. Both the double magnetized sheet and the double magnetized strips can substantially turn through 360 degrees which can magnetically attach to a corresponding side independently and/or together. A user may place as many magnetic repositionable strips 113 as available or necessary over information or records 120 and identity or signature authentication records 122 to cover private, personal, confidential, nonpublic, intellectual property, or secret information during use of the book 110 or other information and/or records containing private, and/or nonpublic information such as, for example, a book title, newspaper title and/or article, magazine title or cover, page, note, material, notebook, file, form, accounting ledger, business journal, blank book, log, scientific record, guest book, sign-in sheet, record sheet, sign, billboard, easel paper, poster, book, general office stationery, manifold book, day book, diary, portfolio, other stationary, etc. The size of the magnetized covering device 112 can be customized to cover the first side 114 and second side 116 of the book 110 or other information or records mentioned above.

In an alternative embodiment, the double magnetized covering device 112 is configured to include one or more accessible handling tabs (not shown), which can be attached to, or a component of the double magnetized sheet or strip 132, 113, which can be placed, attached, or part of a double magnetized sheet or strip 132, 113, which can be in a horizontal, vertical, or other orientation.

In yet another alternative embodiment, the magnetized covering device 112 can be configured as a one-piece magnetic folder (also referred to as a sleeve) (not shown) covering device having at least two releasably connected substantially opaque sides and configured in a plurality of shapes, sizes, and materials, such that the magnetic folder covering device can be placed over any portion of or completely around or over one or more pages and magnetically adhere to its opposing side. The magnetic folder covering device may include a magnetic strip, component, or border, and can have one or more accessible handling tabs, which can be attached to or are a component of the magnetic folder and/or magnetic strip and placed at one or both ends of the magnetic folder, strip, or a top or bottom of the magnetic folder or strip.

Figure 6:
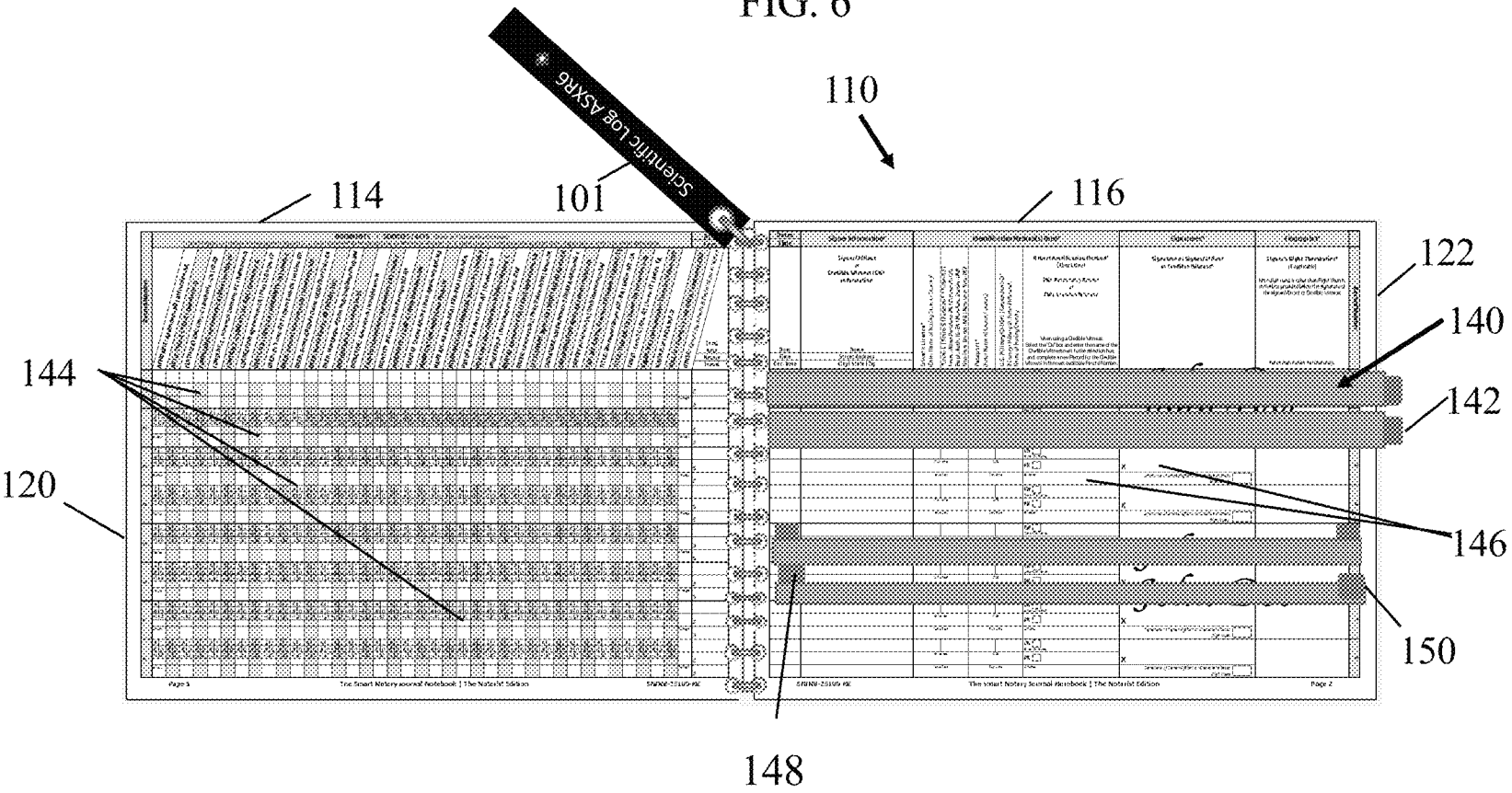
FIG. 6 shows an exemplary view of an alternative covering device for use with systems and methods for providing security, binding, and labeling for a plurality of papers and their covers, and covering, protecting, and concealing the recording, viewing, or using of personal, private, and nonpublic information on the pages, according to one embodiment of the present invention.

FIG. 6 shows an exemplary view of an alternative covering device configured as a repositionable substantially opaque adhesive strip 140 for use with systems and methods for providing security, binding, and labeling for a plurality of papers and their covers, and covering, protecting, and concealing the recording, viewing, or using of personal, private, and nonpublic information on the pages, according to one embodiment of the present invention. As shown in this embodiment, the book 110 is in an open position. The repositionable substantially opaque adhesive strip 140 is configured to cover information 144 and/or shown on information records 120 and/or information 146 shown on identification or signature authentication records 122. In an embodiment, the repositionable substantially opaque adhesive strip 140 has repositionable adhesive on a bottom side (not visible) that allows for adhering to information or records 120 or identification or signature authentication records 122 yet is releasable on demand. In one embodiment, the repositionable substantially opaque adhesive strip 140 includes one or more tabs 142 (shown only at the top of the repositionable substantially opaque adhesive strip 140 for illustration purposes) for convenient placement and removal of the repositionable substantially opaque adhesive strip 140. A user may include as many repositionable substantially opaque adhesive strips 140 as necessary over the information, records 120, or identification or signature authentication records 122 to cover private and nonpublic information during use of the journal 110. In an alternative embodiment, the repositionable substantially opaque adhesive strips 140 include a first tab 148 and a second tab 150 for ease of removal and repositioning of the repositionable substantially opaque adhesive strips 140. In another embodiment, the repositionable substantially opaque adhesive strips 140 are utilized to cover other information or records containing private, or nonpublic information such as, for example, a book title, newspaper title and/or article, magazine title or cover, page, note, material, notebook, file, form, accounting ledger, business journal, blank book, log, scientific record, guest book, sign-in sheet, record sheet, sign, billboard, easel paper, poster, book, general office stationary, manifold book, day book, diary, portfolio, other stationary etc.

Figure 7:
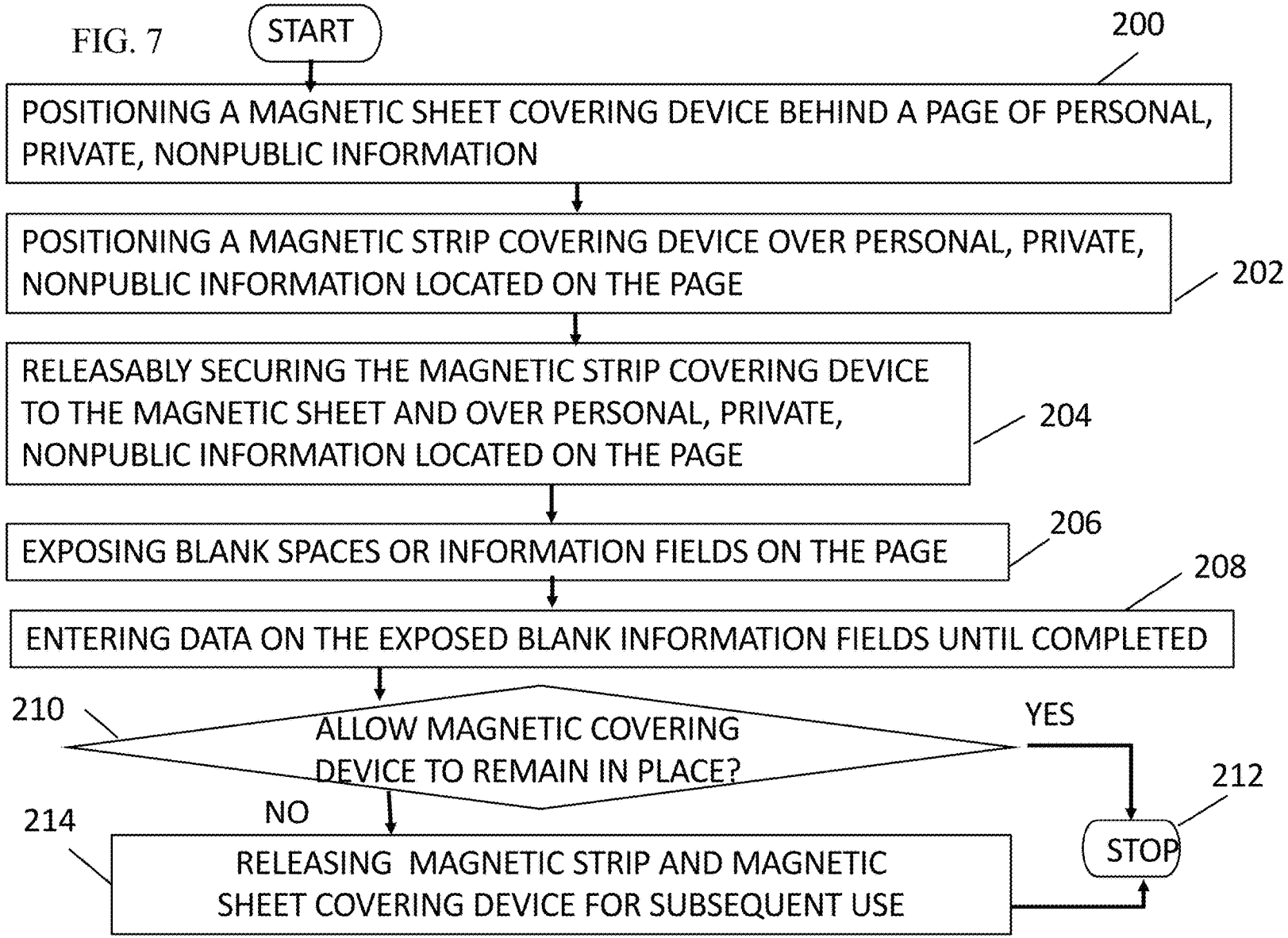
FIG. 7 shows a flowchart illustrating a method for utilizing a covering device with systems and methods for providing security, binding, and labeling for a plurality of papers and their covers, and covering, protecting, and concealing the recording, viewing, or using of personal, private, and nonpublic information on the pages, according to one embodiment of the present invention.

FIG. 7 shows a flowchart illustrating a method for utilizing a covering device with systems and methods for providing security, binding, and labeling for a plurality of papers and their covers, and covering, protecting, and concealing the recording, viewing, or using of personal, private, and nonpublic information on the pages, according to one embodiment of the present invention. At 200, a covering device, configured as a magnetic sheet is positioned behind a page of personal, private, and/or nonpublic information. At 202, a magnetic strip is positioned over the personal, private, and/or nonpublic information located on the page. At 204, the magnetic strip, releasably secured to the magnetic sheet, is turned and positioned over the personal, private, and nonpublic information located on the page. At 206, other information such as blank spaces, private or nonpublic information, fields, or records are not covered and left exposed on the page. At 208, data is entered on a blank information field until all data is entered and completed. For example, if signature authentication is required, then at 208 the blank information fields on the document are completed and the signature is authenticated and the process continues by completing additional information fields and adding repositionable strips to cover the preceding information entered until all preferred information is completed and covered. At 210, a determination is made whether or not to allow the magnetic strip covering device to remain in place. If yes, at 212, the process ends. If not, at 214, the magnetic strip covering device and associated magnetic sheet are released for subsequent use. At 212, the process ends.

Figure 8A:
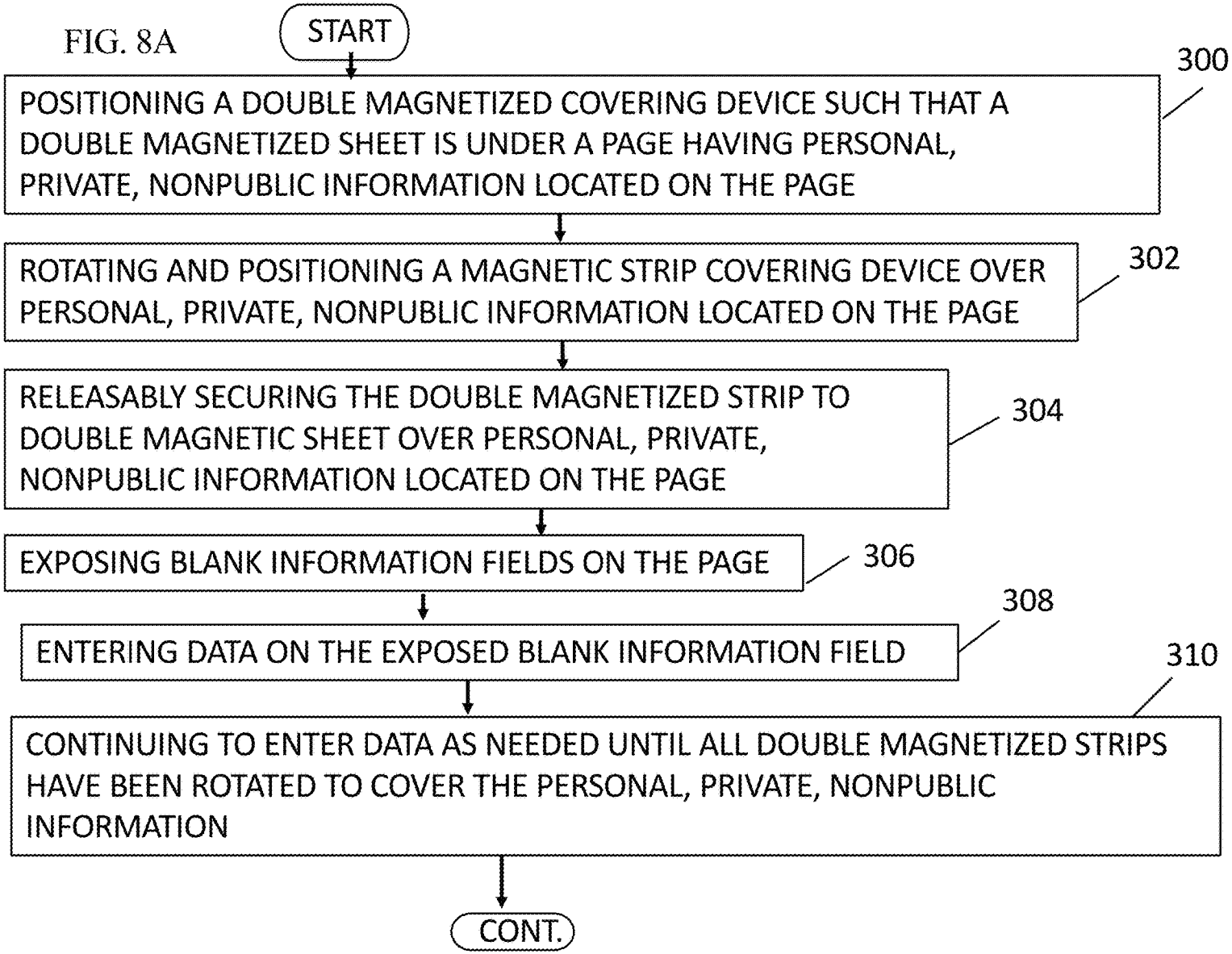
FIGS. 8A and 8B show flowcharts illustrating a method for utilizing an alternative covering device with systems and methods for providing security, binding, and labeling for a plurality of papers and their covers, and covering, protecting, and concealing the recording, viewing, or using of personal, private, and nonpublic information on the pages, according to one embodiment of the present invention, wherein the covering device comprises a double magnetized sheet and connected double magnetized strips, according to one embodiment of the present invention.
Figure 8B:
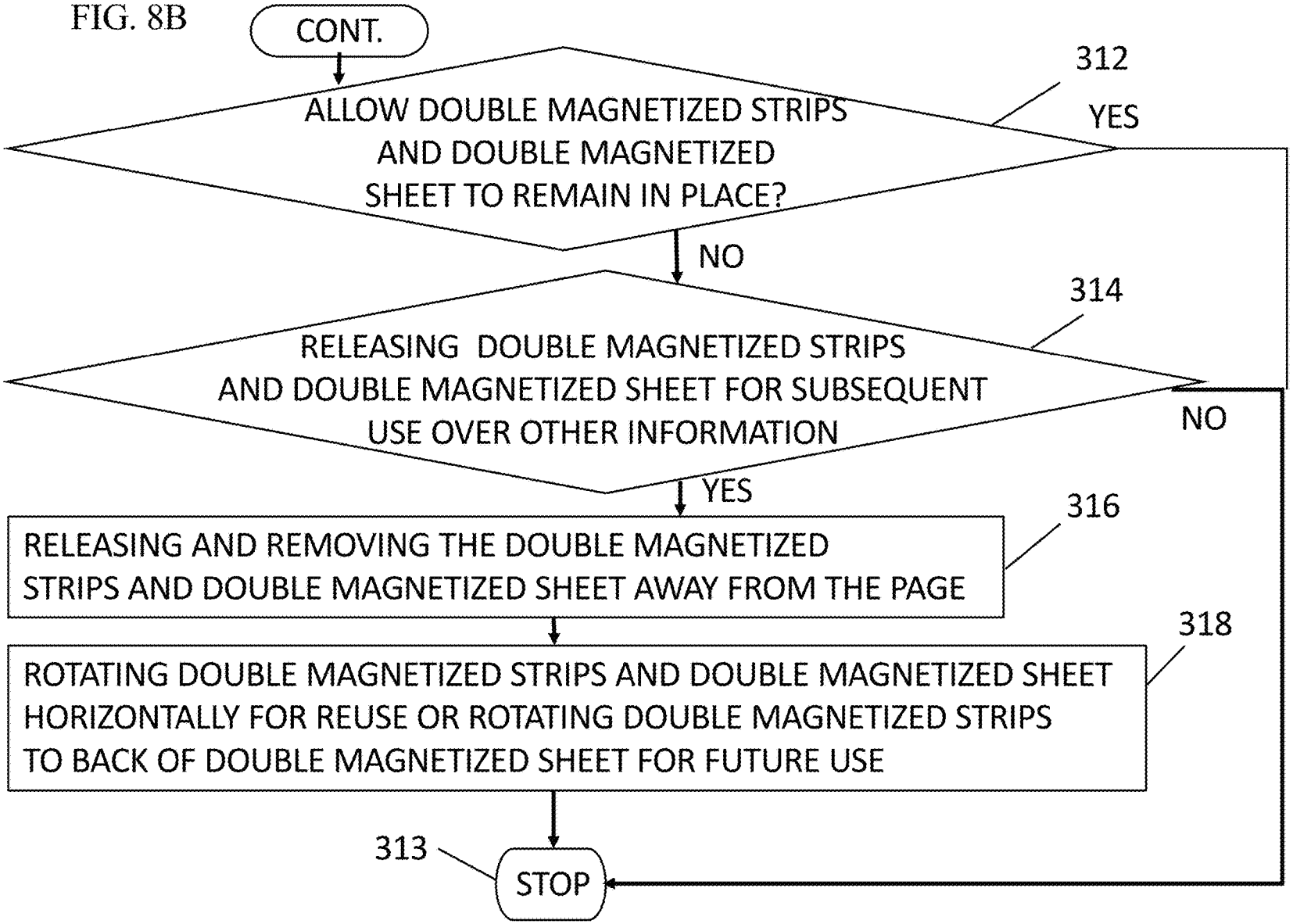

FIGS. 8A and 8B show flowcharts illustrating a method for utilizing an alternative covering device with systems and methods for providing security, binding, and labeling for a plurality of papers and their covers, and covering, protecting, and concealing the recording, viewing, or using of personal, private, and nonpublic information on the pages, according to one embodiment of the present invention, wherein the covering device comprises a double magnetized sheet and connected double magnetized strips. At 300, position double magnetized covering device having a double magnetized sheet under a page having personal, private, and nonpublic information located on the page. At 302, turn one or more double magnetized strips connected to the double magnetic sheet and position the double magnetized strip over personal, private, and nonpublic information located on the page. At 304, the double magnetic strips are releasably adhered to the double magnetic sheet in a manner to allow the magnetic components of the magnetic and repositionable strip and magnetic sheet to adhere to each other and remain in place on the page and covering the private or nonprivate information. At 306, blank information fields are left exposed on the page. At 308, entering data on the exposed blank information fields. At 310, continuing to enter data as needed until all double magnetized strips have been rotated to cover the personal, private, and nonpublic information on the page. In an alternative embodiment, the covering device is configured as a bound together, one-piece combination covering device unit configured with magnetic strips and a magnetic sheet. At 312, a determination is made whether to allow the double magnetized strips and double magnetized sheet to remain in place. If yes, the process stops at 313. If no, the process continues at 314. At 314, a determination is made whether to release the double magnetized strips and double magnetic sheet for subsequent use over other information fields. If no, the process stops at 313. If yes, the process continues at 316. At 316, the double magnetized strips and double magnetized sheet are slid and/or pulled away from the page. In a preferred embodiment, the double magnetized strips are configured to connect to the double magnetized sheet. At 318, the double magnetized strips and double magnetized sheet are rotated horizontally for reuse. Alternatively, the double magnetized strips are rotated to a back side of the double magnetized sheet for future use. At 313, the process stops.

An advantage of the present invention is a book, a bound plurality of papers and their covers, or journal is well-bound, in that it assists in maintaining the integrity of the contents when configured with the binding device which allows a book, plurality of papers and their covers, or journal to lie flat and/or fold back upon itself, which provides for maneuverability and ease of use of a book, plurality of papers, or journal.

Another advantage of the present invention is a book, a bound plurality of papers and their covers, or journal is having an identification label that can expose the title or contents, can be concealed within the book, plurality of papers and their covers, or journal, concealing identifying title or content information, and be used as a place marker.

Another advantage of the present invention is the book, bound plurality of papers, or journal is that it reduces private, personal, confidential, nonpublic, intellectual property, or secret information exposure of one-half of the book, plurality of papers, or journal, when folded back upon itself.

Another advantage of the present invention is the information records of the journal are organized to provide for rapid recording options and quick reference lists.

Still another advantage of the present invention is the inclusion of a tamper-evident security device and/or security seal such that a book, plurality of papers and their covers, or journal's binding device cannot be removed without being tamper-evident. The tamper-evident security device provides security enhancement and integrity to a book, plurality of papers and their covers, or journal, and/or its contents when in a lay flat, fold back binding style.

Yet another advantage of the present invention is the covering devices cover information easily and affordably, generally remain in place until removed, are reusable, easy to carry and use, and can be custom sized or custom printed.

The present invention has been described above with reference to exemplary embodiments. Other embodiments will be apparent to those skilled in the art in light of this disclosure. The present invention may readily be implemented using configurations other than those described in the exemplary embodiments above. Therefore, these and other variations upon the exemplary embodiments are covered by the present invention.

I claim:

1. A system for securing a plurality of papers, comprising:

a spine binder shaft having a posterior side and a bendable center axis;

a first plurality of loop fasteners connected to the posterior side of the spine binder shaft and having a first end configured as a male connector;

a second plurality of loop fasteners connected to the posterior side of the spine binder shaft and having a first end configured as a female connector and configured to receive and engage the male connector of the first plurality of loop fasteners to form a cooperating pair of loop fasteners that close to bind the plurality of papers, wherein when closed, the spine binder shaft, first plurality of loop fasteners, and second plurality of loop fasteners form a continuous unit and when the first and second plurality of loop fasteners are closed, a bound plurality of papers, can rotate substantially 360 degrees to fold back upon itself and lie flat when the bound plurality of papers are open, wherein the male connector further comprises a shank having at least two compressible tabs at an end of a rimmed head plug whereby the shank tabs can compress for insertion into the female connector and decompress once inserted into the female connector to latch and secure; and a tamper-evident security feature configured to cooperate with the spine binder shaft, wherein upon closing the tamper-evident security feature prevents removal and insertion of a page without evidence of tampering.

2. A system for securing a plurality of papers, comprising:

a spine binder shaft having a posterior side and a bendable center axis;

a first plurality of loop fasteners connected to the posterior side of the spine binder shaft and having a first end configured as a male connector;

a second plurality of loop fasteners connected to the posterior side of the spine binder shaft and having a first end configured as a female connector and configured to receive and engage the male connector of the first plurality of loop fasteners to form a cooperating pair of loop fasteners that close to bind the plurality of papers, wherein when closed, the spine binder shaft, first plurality of loop fasteners, and second plurality of loop fasteners form a continuous unit and when the first and second plurality of loop fasteners are closed, a bound plurality of papers, can rotate substantially 360 degrees to fold back upon itself and lie flat when the bound plurality of papers are open, wherein the male connector further comprises a shank having compressible center channel at an end of a rimmed head plug for insertion into the female connector whereby the rimmed head plug can compress for insertion into the female connector and decompress once inserted into the female connector to latch and secure; and a tamper-evident security feature configured to cooperate with the spine binder shaft, wherein upon closing the tamper-evident security feature prevents removal and insertion of a page without evidence of tampering.

3. A system for securing a plurality of papers, comprising:

a spine binder shaft having a posterior side and a bendable center axis;

a first plurality of loop fasteners connected to the posterior side of the spine binder shaft and having a first end configured as a male connector;

a second plurality of loop fasteners connected to the posterior side of the spine binder shaft and having a first end configured as a female connector and configured to receive and engage the male connector of the first plurality of loop fasteners to form a cooperating pair of loop fasteners that close to bind the plurality of papers, wherein when closed, the spine binder shaft, first plurality of loop fasteners, and second plurality of loop fasteners form a continuous unit and when the first and second plurality of loop fasteners are closed, a bound plurality of papers, can rotate substantially 360 degrees to fold back upon itself and lie flat when the bound plurality of papers are open, wherein the first plurality of loop fasteners and the second plurality of loop fasteners and the spine binder shaft are constructed of magnetic material to releasably attach and adhere to a magnetic label having indicia printed with information regarding the bound plurality of papers.

4. A system for securing a plurality of papers, comprising:

a spine binder shaft having a posterior side and a bendable center axis;

a first plurality of loop fasteners connected to the posterior side of the spine binder shaft and having a first end configured as a male connector;

a second plurality of loop fasteners connected to the posterior side of the spine binder shaft and having a first end configured as a female connector and configured to receive and engage the male connector of the first plurality of loop fasteners to form a cooperating pair of loop fasteners that close to bind the plurality of papers, wherein when closed, the spine binder shaft, first plurality of loop fasteners, and second plurality of loop fasteners form a continuous unit and when the first and second plurality of loop fasteners are closed, a bound plurality of papers, can rotate substantially 360 degrees to fold back upon itself and lie flat when the bound plurality of papers are open; and a tamper-evident security feature configured to cooperate with the spine binder shaft, wherein upon closing the tamper-evident security feature prevents removal and insertion of a page without evidence of tampering, wherein the spine binder shaft further comprises material selected from the group consisting of plastic, metal, wood, leather, fabric, steel, tin, vinyl, precious metal, stone, cord, carbon fiber, resin, graphene, synthetic elastomer, fiberboard, poly, acrylic, acrylic glass, plexiglass, bio-plastic, eco-plastic, polyester, rubber, and silicone, and further comprises at least one label selected from the group consisting of an identification label, tag, identification tag, identifier, identification, identification mark, identification marker, spine label, electronic identifier, electronic tag, microchip tag, transponder, digital identifier, book spine poetry, book marker, and decorative tag, the label further comprising material selected from the group consisting of plastic, metal, paper, silk, wood, cardboard, leather, fabric, ribbon, felt, steel, tin, vinyl, precious metal, stone, mineral, ornament, cord, foil, carbon fiber, resin, graphene, synthetic elastomer, fiberboard, poly, acrylic, acrylic glass, plexiglass, bio-plastic, eco-plastic, polyester, silicone, rubber, magnetic seal, and cardstock, the label further comprising at least one indicia selected from the group consisting of at least one mark, letter, number, sequential number, watermark, bar code, author, title, logo, publisher, trademark, brand, decoration, price, picture, descriptor, category, lettering, clip art, image, design, graphic, website, endorsement, electronic identification, transponder, and microchip with information regarding the bound plurality of papers.

5. A system for securing a plurality of papers, comprising:

a spine binder shaft having a posterior side and a bendable center axis;

a first plurality of loop fasteners connected to the posterior side of the spine binder shaft and having a first end configured as a male connector;

a second plurality of loop fasteners connected to the posterior side of the spine binder shaft and having a first end configured as a female connector and configured to receive and engage the male connector of the first plurality of loop fasteners to form a cooperating pair of loop fasteners that close to bind the plurality of papers, wherein when closed, the spine binder shaft, first plurality of loop fasteners, and second plurality of loop fasteners form a continuous unit and when the first and second plurality of loop fasteners are closed, a bound plurality of papers, can rotate substantially 360 degrees to fold back upon itself and lie flat when the bound plurality of papers are open, wherein the spine binder shaft further comprises a shaft having a combining hole and a label having indicia with information regarding the bound plurality of papers, wherein the label is adapted with at least one combining hole to attach the label to the spine binder shaft and wherein the indicia can be concealed and wherein the label can be used as a place marker when the label is placed within a bound plurality of papers; and a tamper-evident security feature configured to cooperate with the spine binder shaft, wherein upon closing the tamper-evident security feature prevents removal and insertion of a page without evidence of tampering.

6. A system for binding a plurality of papers, comprising:

a binding device to secure a plurality of papers, wherein the bound plurality of papers, can rotate substantially 360 degrees to fold back upon itself and lie flat when the bound plurality of papers are open; and a tamper-evident security feature wherein upon closing the tamper-evident security feature prevents removal and insertion of page without evidence of tampering, wherein the binding device is selected from the group consisting of spiral, coil, and wire, and the tamper-evident security feature is selected from the group consisting of indicative seal, barrier seal, security seal, security sticker, plastic seal, metal seal, adjustable length seal, banking seal, fixed seal, bolt seal, screw seal, security ring, locking seal, padlock seal, electronic identification tag, microchip tag, personal identifier tag, transponder, and digital identifier, wherein the tamper-evident security feature is inserted through at least one combining hole of the plurality of papers.

7. A system for securing a plurality of papers, comprising:

a spine binder shaft having a posterior side and a bendable center axis;

a first plurality of loop fasteners connected to the posterior side of the spine binder shaft and having a first end configured as a male connector;

a second plurality of loop fasteners connected to the posterior side of the spine binder shaft and having a first end configured as a female connector and configured to receive and engage the male connector of the first plurality of loop fasteners to form a cooperating pair of loop fasteners that close to bind the plurality of papers, wherein when closed, the spine binder shaft, first plurality of loop fasteners, and second plurality of loop fasteners form a continuous unit and when the first and second plurality of loop fasteners are closed, a bound plurality of papers, can rotate substantially 360 degrees to fold back upon itself and lie flat when the bound plurality of papers are open, wherein the first plurality of loop fasteners and the second plurality of loop fasteners and the spine binder shaft are constructed of magnetic material to releasably attach and adhere to a magnetic label having indicia printed with information regarding the bound plurality of papers; and a tamper-evident security feature configured to cooperate with the spine binder shaft, wherein upon closing the tamper-evident security feature prevents removal and insertion of a page without evidence of tampering.

* * * * *